US008465406B2

(12) United States Patent
Overberg et al.

(10) Patent No.: US 8,465,406 B2
(45) Date of Patent: Jun. 18, 2013

(54) CENTRIFUGE INCLUDING A FRAME AND A BEARING DEVICE HAVING A PAIR OF CANTILEVERS AND A PAIR OF SPRING ELEMENTS LOCATED BETWEEN THE CANTILEVERS AND THE FRAME

(75) Inventors: Martin Overberg, Herzebrock-Clarholz (DE); Stefanos Doudis, Oelde (DE); Stefan Terholsen, Oelde (DE); Helmut Figgener, Oelde (DE); Hans-Joachim Beyer, Ennigerloh (DE)

(73) Assignee: Westfalia Separator GmbH, Oelde (DE)

( * ) Notice: Subject to any disclaimer, the term of this patent is extended or adjusted under 35 U.S.C. 154(b) by 598 days.

(21) Appl. No.: 12/440,389

(22) PCT Filed: Sep. 7, 2007

(86) PCT No.: PCT/EP2007/059421

§ 371 (c)(1),
(2), (4) Date: Feb. 19, 2010

(87) PCT Pub. No.: WO2008/031775

PCT Pub. Date: Mar. 20, 2008

(65) Prior Publication Data

US 2010/0167902 A1 Jul. 1, 2010

(30) Foreign Application Priority Data

Sep. 11, 2006 (DE) ..... 10 2006 043 265

(51) Int. Cl.
*B04B 1/20* (2006.01)
*B04B 9/12* (2006.01)

(52) U.S. Cl.
USPC ..... 494/53; 494/82; 494/83; 384/218

(58) Field of Classification Search
USPC ... 494/50–55, 82, 83; 248/665, 667; 384/218; 210/380.1, 380.3
See application file for complete search history.

(56) References Cited

U.S. PATENT DOCUMENTS 1,210,085 A * 12/1916 Leblanc ..... 384/218
2,094,058 A 9/1937 Bryson
2,141,122 A * 12/1938 Boden ..... 384/582

(Continued)

FOREIGN PATENT DOCUMENTS

DE 711095 C 9/1941
DE 66 09 011 U 1/1972

(Continued)

OTHER PUBLICATIONS

International Searching Authority, Written Opinion for PCT/EP2007/059421, filed Sep. 7, 2007.

*Primary Examiner* — Charles E Cooley
(74) *Attorney, Agent, or Firm* — Barnes & Thornburg LLP

(57) ABSTRACT

A screw centrifuge including a drum having a rotor, the drum having two axial ends and a horizontal axis of rotation, and a screw arranged in the drum and configured to rotate relative to the drum at a speed different from a rotation speed of the drum. Also included is a bearing device located at each axial end of the drum and configured to bear the drum. Each bearing device includes a housing and a pair of cantilevers extending in opposite directions away from the housing. Further included is a pair of spring elements associated with each bearing device and configured for sprung support of the drum. Each spring is arranged between one of the cantilevers and a frame, the spring elements being located at each axial end of the drum.

27 Claims, 3 Drawing Sheets

U.S. PATENT DOCUMENTS

| | | | | | |
|---|---|---|---|---|---|
| 2,141,145 | A | * | 12/1938 | Wooler et al. | 384/565 |
| 2,487,343 | A | * | 11/1949 | Kopf | 384/535 |
| 2,556,317 | A | * | 6/1951 | Cook | 384/535 |
| 3,003,831 | A | * | 10/1961 | King et al. | 384/536 |
| 3,078,035 | A | * | 2/1963 | Bruenig | 494/46 |
| 3,389,881 | A | | 6/1968 | Stelwagen | |
| 4,236,426 | A | | 12/1980 | Meinke et al. | |
| 4,504,262 | A | * | 3/1985 | Forsberg | 494/53 |
| 4,640,770 | A | | 2/1987 | Smith | |
| 5,437,599 | A | * | 8/1995 | Feldkamp et al. | 494/82 |
| 5,502,342 | A | * | 3/1996 | Feldkamp et al. | 310/91 |
| 5,800,070 | A | * | 9/1998 | Nilsson et al. | 384/535 |
| 6,224,533 | B1 | * | 5/2001 | Bengtsson et al. | 494/82 |
| 7,694,540 | B2 | * | 4/2010 | Ishida et al. | 384/624 |
| 2010/0167902 | A1 | * | 7/2010 | Overberg et al. | 494/66 |

FOREIGN PATENT DOCUMENTS

| | | | | |
|---|---|---|---|---|
| DE | 26 06 589 | A1 | | 9/1976 |
| DE | 26 32 586 | A1 | | 1/1978 |
| DE | 3134633 | A1 | | 6/1982 |
| DE | 4213092 | C1 | * | 8/1993 |
| DE | 43 15 694 | A1 | | 11/1994 |
| DE | 102007026882 | A1 | * | 12/2008 |
| EP | 0 107 470 | A2 | | 1/1990 |
| SU | 1342530 | A1 | * | 10/1987 |
| SU | 1482731 | A1 | * | 5/1989 |
| SU | 1554981 | A2 | * | 4/1990 |
| WO | WO 94/07605 | A1 | | 4/1994 |
| WO | WO 2008031775 | A1 | * | 3/2008 |

* cited by examiner

CENTRIFUGE INCLUDING A FRAME AND A BEARING DEVICE HAVING A PAIR OF CANTILEVERS AND A PAIR OF SPRING ELEMENTS LOCATED BETWEEN THE CANTILEVERS AND THE FRAME

BACKGROUND AND SUMMARY

The present disclosure relates to a screw centrifuge including a drum having a rotor, two axial ends and a horizontal axis of rotation. The screw centrifuge also includes a screw arranged in the drum and configured to rotate relative to the drum at a speed different than a rotation speed of the drum and also includes a bearing device located at each axial end of the drum and configured to bear the drum. The screw centrifuge also includes a plurality of spring elements configured for sprung support of the drum on a frame and at least one of the plurality of spring elements is located at each axial end of the drum.

EP 0 107 470 B1 and U.S. Pat. No. 4,504,262 disclose the drums of decanters, such as complete-casing screw centrifuges, being supported in a sprung manner. The springs are in the form of helical springs which are aligned radially with respect to the axis of rotation. A sprung support is provided between the bearing housings of the bearings of the drum and a supporting ring by threaded bolts which pass through the helical springs. The supporting ring is arranged concentrically with respect to the bearing housing and is attached to the machine frame or is connected thereto. This makes it possible to select operating rotation speeds above the main resonant frequency of the system. In design terms, there need be only a relatively small clearance between the bearing housings and the supporting rings which surround them.

WO 94/07605 discloses a similar design to the documents cited above, but with only one axial end of the drum being supported in a sprung manner.

An elongated centrifuge with a device for reducing structure-borne sound transmissions is disclosed in DE 43 15 694 A1.

Bearings which are suitable for rather physically short drums and are not supporting but are designed to be suspending are disclosed in DE 26 06 589 A1, DE 31 34 633 A1 and DE 66 09 011 U.

With regard to the technological background, see also DE 26 32 586 A1, U.S. Pat. No. 2,094,058, U.S. Pat. No. 4,640,770 and DE 711 095 C.

In comparison to this prior art, the present disclosure provides for a better sprung support from the drum, or the entire rotor with the drum, for a centrifuge of a generic type. In particular, this is intended to be suitable for elongated designs in which the ratio between the length of the rotor and the diameter of the rotor is greater than 2.

The present disclosure thus relates to a screw centrifuge including a drum having a rotor, two axial ends and a horizontal axis of rotation. The screw centrifuge also includes a screw arranged in the drum and configured to rotate relative to the drum at a speed different than a rotation speed of the drum and also includes a bearing device located at each axial end of the drum and configured to bear the drum. The screw centrifuge also includes a plurality of spring elements configured for sprung support of the drum on a frame. At least one of the plurality of spring elements is located at each axial end of the drum and each of the plurality of spring elements is aligned essentially vertically.

As noted above, the spring elements are aligned vertically or essentially vertical.

The support is provided by combined spring/damping elements or spring elements and damping elements which are separate from them.

The drum or the entire rotor with the drum is supported in a sprung manner without there being any narrow gaps in the area of the sprung support between the parts which can move relative to one another. Such narrow gaps would make the system relatively difficult to manage.

In contrast to the situation with the prior art, the present disclosure makes it possible, without any problems, to operate the drum at an operation rotation speed which is considerably above the fundamental resonant frequency, or rotor natural shape, of the system.

This results in the creation of a centrifuge with a horizontal axis of rotation, which has an optimized sprung bearing of the rotor so as to produce an optimized behavior during operation.

The screw centrifuge of the present disclosure is suitable for elongated designs in which the ratio between the length of the rotor or the drum and the diameter of the rotor or the drum is preferably greater than 2, or possibly greater than 2.5, or greater than 3.

Because of the length, natural bending shapes or bending lines of the rotor are formed at specific frequencies in very long rotors. These frequencies are generally somewhat above the normal operating rotation speeds.

Natural rotor frequencies which can limit the possible operating rotation speed are shifted toward higher frequencies by decoupling the frame mass or foundation mass. This makes it possible to considerably increase the operating rotation speed.

Since, in addition to spring characteristics, the spring elements also have significant damping characteristics. Or, since damping elements are provided in addition to the supporting spring elements, this results in the capability of specific damping of the oscillatory rotor system, and this offers a number of advantages.

For example, the deflection when passing through critical rotation speeds, such as resonant rotation speeds or resonant frequencies, for example, of the rotor system in comparison to the machine frame or foundation when the screw centrifuge is being started up and shut down, is limited to very small values. This prevents the moving parts from striking the stationary parts.

The design, according to the present disclosure, means that it is possible to operate the screw centrifuge super critically at a very high rotation speed with regard to the first natural rotor frequencies. As a result, the operating rotation speed may be above the first resonant frequency of the rotor or of the rotor parts, such as the drum and screw.

Since, furthermore, only short distances have to be covered, the gaps, for example between the drum and the thread on the screw, can even be reduced in comparison to the previously proposed solutions for super critical operation, without or with little damping.

Since the gaps are reduced, this also makes it easier to seal them.

The spring elements and the damping elements have frequency-dependent, non-constant characteristics. As a result, it is possible to minimize the deflection movements, that is to say the distances through which the rotor is deflected with respect to the foundation or the machine frame at resonant frequencies.

Since the drums are filled with liquid when they are rotating during operation, this liquid can also cause the screw centrifuge to oscillate, particularly when partially filled during starting up and shutting down.

The combination of spring and damping furthermore makes it possible to ensure that the rotor is not caused to excite impermissible oscillations from the outside.

Excitations from the outside generally occur only at a relatively low amplitude.

However, they could by accident provide excitation precisely at a resonance of the system. In the case of an excessively lightly damped system, the rotor would then carry out undesirable oscillations.

The chosen positioning of the spring elements directly on the drum bearing allows, furthermore, isotropic damping in the vertical and horizontal directions which can be influenced by suitable adaptation of the damper. This can occur, in a desired manner, as well as anisotropically. Isotropic damping is advantageous.

The damping is a function of the rotation speed and movement and is designed such that a high damping level is produced even at low rotation speeds when driving through the rotor natural frequencies. A relatively low damping level is provided at the operating rotation speed above the resonant frequency. This effectively limits the deflections when driving through the natural frequency.

The damping at resonance should be at least 3%. Good results are achieved with dampings between 10% and 30%. Damping is understood to mean the conversion of the oscillation energy to a different energy form, for example heat. The energy conversion results in the amplitudes in the region of the resonant frequency being reduced. The quotation of the damping, as percentages, should be understood within the meaning of the Lehr damping measure D as meaning the following.

$D=d/\omega_0$, where $d$ (decay constant of the envelope $e$-function)=(k/2 m) and $\omega_0$ (natural frequency of the undamped system)=$\sqrt{(c/m)}$, and $c$=spring constant.

In the case of the operating rotation speed, in contrast, the low damping results in low dynamic bearing forces, which makes a long bearing life possible. In this context, it is advantageous for the system to be tuned such that the resonant frequency is reached at a rotation speed which is less than 70% of the operating rotation speed, or even less than half the operating rotation speed.

In summary, according to the present disclosure, a screw centrifuge, such as one with a complete casing, can be produced such that a high operating rotation speed can be made use of.

It should also be mentioned as being advantageous that, according to the present disclosure, despite this high operating rotation speed, a screw centrifuge is created which operates relatively quietly. That is because the structure-borne sound introduced is reduced and is particularly low because the rotating system does not transmit undamped structure-borne sound directly to a housing or to a frame.

The housing of the screw centrifuge, according to the present disclosure, also has a particularly compact design.

Other aspects of the present disclosure will become apparent from the following descriptions when considered in conjunction with the accompanying drawings.

DETAILED DESCRIPTION

Figure 1:
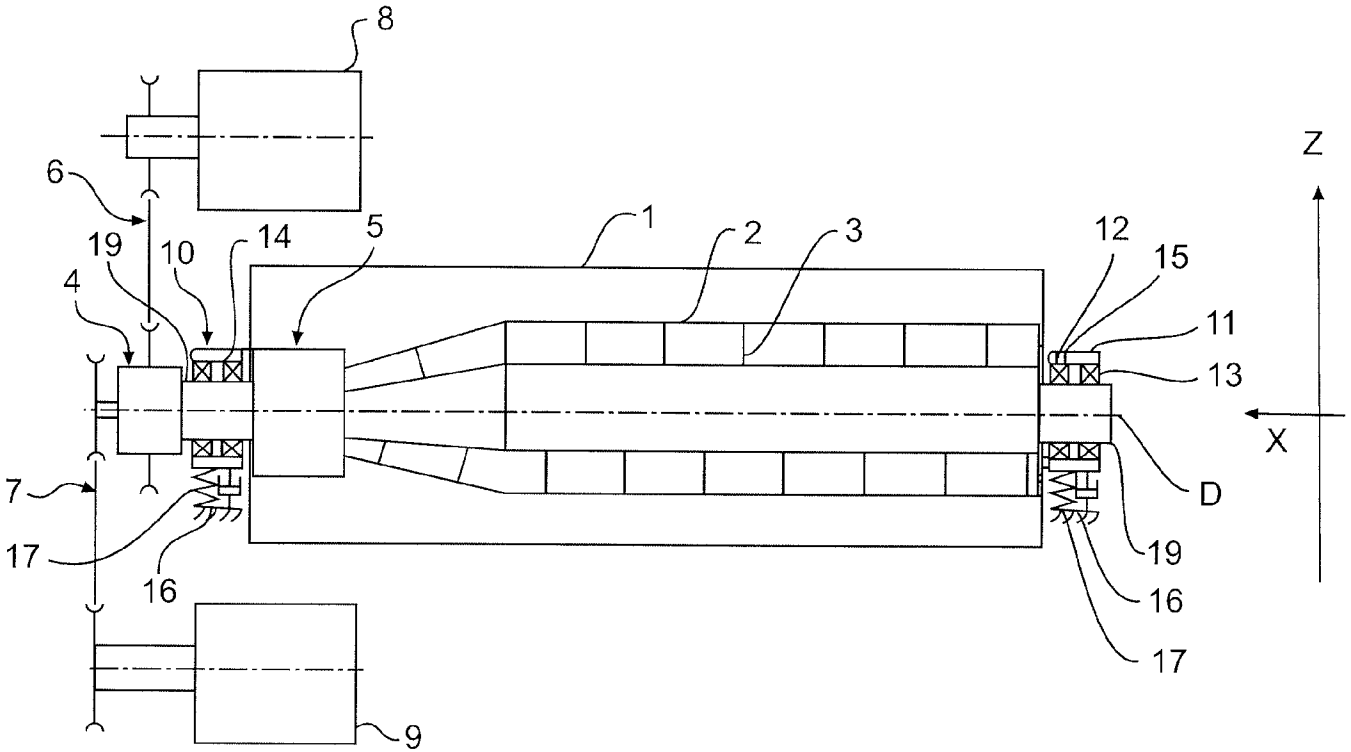
FIG. 1 is a side view of a full-casing screw centrifuge, according to the present disclosure.

FIG. 1 shows a full-casing screw centrifuge having a housing 1 which surrounds a rotatable drum 2 with a horizontal rotation axis D.

A screw 3, which can be rotated at a different rotation speed in comparison to the drum 2, is arranged in the drum 2.

As an example, a drive apparatus with a gearbox having gearbox stages 4, 5 is used for the drive. The gearbox stage 4 is driven via belt drives 6, 7 from a first motor 8 and a second motor 9.

The drum 2, or the entire rotor, as the entire rotating area of the full-casing screw centrifuge, has at least one spindle 19 and the screw 3. The drum 2 is borne such that it can rotate by way of bearing devices 10, 11 which are arranged at the two axial ends of the drum 2.

By way of example, and advantageously, one of the two bearing devices, bearing device 10, is arranged about the spindle 19 between the two gearbox stages 4, 5. This is axially outside one of the axial ends of the drum 2. The other bearing device 11 is arranged axially outside the other axial end of the drum 2.

The bearing devices 10, 11 each comprise two roller bearings or plain bearings 12, 13 with bearing housings 14, 15. Housings 14, 15 are supported by spring elements 17, 18 on a machine frame 16.

It is advantageous for one of the bearings, bearing 12, to be in the form of a groove ball bearing and for the other bearing, bearing 13, to be in the form of a cylindrical roller bearing. As a result, the cylindrical roller bearing 13 provides radial support, and the groove ball bearing 12 provides axial and radial support.

Because the axial forces are low, however, it is also possible to use a further cylindrical roller bearing as a fixed bearing instead of the groove ball bearing, with this being equipped with appropriate rims.

At each of its two axial ends, the rotor is supported by two of the spring elements 17, 18 in a sprung manner on the machine frame 16 or on a foundation. In this case, the spring elements 17, 18 provide sprung support for the drum 2 on the machine frame 16 or foundation in a non-radial direction, as compression elements.

In the embodiment shown, the two spring elements 17, 18 are arranged axially, with respect to the axis of rotation D, in the area of the bearing devices 10, 11. They are arranged axially even on a plane between the two bearings 12, 13 of each bearing device 10, 11.

Figure 2:
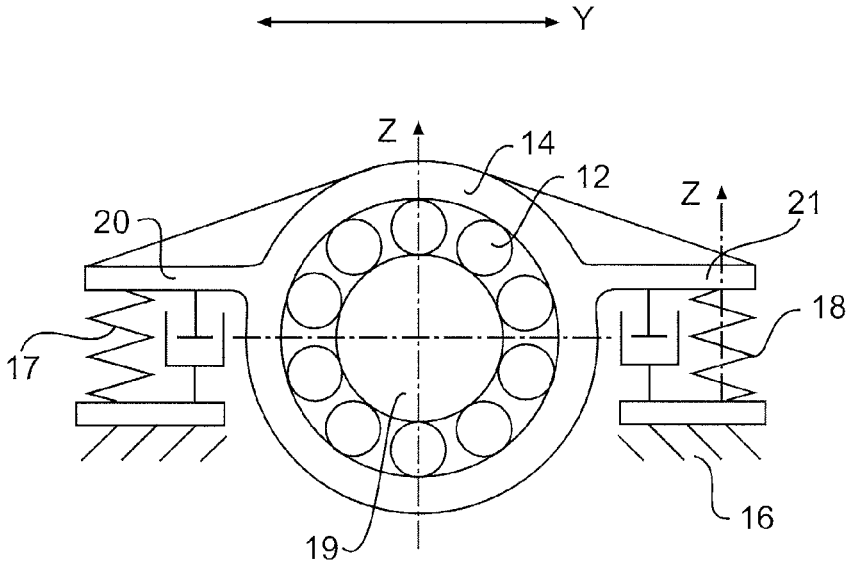
FIG. 2 is a schematic view of FIG. 1 showing an area of one bearing device of the screw centrifuge.

According to the embodiment shown in FIG. 2, the spring elements 17, 18 are in the form of combined spring and damping elements. Spring elements 17, 18 are aligned vertically or essentially vertically, in the Z direction, with respect to the horizontal axis of rotation D, in the X direction, as shown in the coordinate system in FIG. 1.

As can be seen in FIG. 2, this is achieved by the spring and damping elements 17, 18 being arranged between cantilevers 20, 21 on the bearing housings 14, 15 and the machine frame 16. The two cantilevers 20, 21 project from the external circumference of the bearing housings 14, 15 in opposite directions, pointing away from one another. In this case, FIG. 2 shows a horizontal alignment at right angles to the axis of rotation D.

Figure 3:
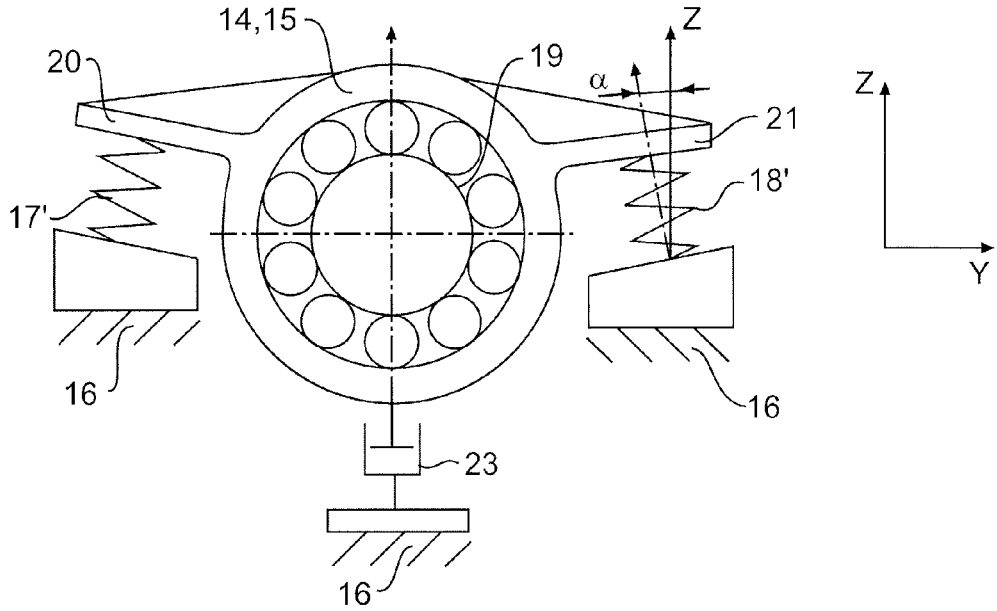
FIG. 3 is a schematic view, analogous to the view in FIG. 2, of another embodiment of the area of a bearing device of a full-casing screw centrifuge, according to the present disclosure.

FIG. 3 shows a configuration at a slight angle to the horizontal Y. The cantilevers 20, 21 are arranged above the horizontally aligned axis of rotation D of the drum 2. The spring and damping elements 17, 18 are arranged at the side, alongside the drum 2, such that their upper end is located above the axis of rotation D of the drum 2, and their lower end is located below the axis of rotation of the drum 2 (see FIG. 2). The center of the springs 17, 18, in the springs' axial direction, is located at the side alongside the bearing housings 14, 15, at a height which corresponds to the height of the center of the bearing housing 14, 15.

The spring elements 17, 18 can be aligned vertically or essentially vertical in an arrangement such as this by virtue of the fact that the spring elements 17, 18 have a spring stiffness in a plurality of directions. That is, in the vertical and in the horizontal direction, as suggested in FIG. 2.

Combined spring and damping elements 17, 18 are used.

Combined spring and damping elements such as these are known.

In design terms, by way of example, they can be provided by using appropriately designed helical springs as spring elements 17, 18, which are arranged in a closed container which is filled with viscous liquid or viscous compound.

The positioning of the spring elements 17, 18 at the side of the bearing housings 14, 15 allows the rotor to be supported in a sprung, virtually isotropic, manner in the vertical and horizontal directions.

Furthermore, the ratio of the two spring rates can be influenced in a desired manner by tuning the vertical and horizontal spring rates of the spring elements 17, 18.

As shown in is FIG. 1, this is achieved, by way of example, by adaptation of the ratio between the length and the diameter of the helical springs.

Each helical spring 17, 18 is loaded in compression in the vertical direction.

Horizontal rotor movements, in contrast, lead to shear in the springs 17, 18. In an embodiment, according to the present disclosure, the horizontal spring stiffness is about 30 to 100% of the vertical spring stiffness.

The use of the spring stiffness in all directions, including the axial direction, makes it possible to use combined spring damper elements, and to install these elements appropriately. This can be done in parallel or virtually parallel.

The parallel installation in the vertical direction is shown in FIG. 2.

However, it is also possible to align each of the spring elements 17, 18 at some angle to the vertical Z, such as angle $\alpha$, as seen in FIG. 3.

The embodiment with two springs 17', 18', which are at an angle to one another upward but are not aligned radially, is shown in FIG. 3. It is within the scope of the present disclosure for the angle $\alpha$ to be aligned in the opposite form (not shown).

The angle $\alpha$ between the longitudinal axes of the spring elements 17', 18', which are in the form of helical springs, relative to the vertical Z, is between 0° and a maximum of 30°, and may be between 0 and 15°.

The vertical alignment results in the advantage that the containers with the viscous compound need not be particularly sealed, as may be necessary when, as is shown in FIG. 3, a vertical alignment is not chosen.

Since the bearing housings 14, 15, or bearing blocks, are supported by the spring elements 17, 17', 18, 18' such that they can tilt, the drum bearings 12, 13 between the bearing blocks 14, 15 and the drum 2 must also be able to absorb tilting moments.

This is achieved by an arrangement of the two bearings 12, 13 at a certain distance apart in the bearing blocks 14, 15. The distance between the bearings 12, 13 is designed such that it corresponds at least to half a bearing internal diameter.

In the case of an installed bearing 12, 13, this applies to the supporting base.

It is within the scope of the present disclosure to provide for solid bearing/loose bearing arrangements, for installed bearings, for floating bearings, for two-row bearings, for roller bearings and for plane bearings of various types.

A fixed bearing/loose bearing arrangement is advantageous.

The fixed bearing/loose bearing arrangement allows relatively simple assembly and does not require any adjustment of the installation.

The drum 2 is driven via belts 6, 7 directly to the drum 2 which is borne in a sprung manner. Suitable tuning of the spring stiffnesses of the spring elements 17, 18 means that a possible change in the shaft forces caused by the belt drive, for example, a decrease in the pre-stressing force caused by the centrifugal forces in the revolving area, would not lead to any unacceptable operating states.

The motors 8, 9 can also be decoupled from the machine frame 16. It is within the scope of the present disclosure to decouple the motors 8, 9 from the machine frame 16, particularly in the case of pedestal-bearing versions.

It is advantageous to use a plurality of motors 8, 9 which are arranged on a common plate.

The accommodation of all the components in or on a common housing allows the design to be in the form of a unit ready for installation, which is delivered completely tested.

The installation at the customer's premises is then restricted to wiring and connection of the pipelines.

As shown in FIG. 3, the spring elements 17, 18 are arranged spatially/physically separate from damping elements 23. In this case, the spring elements 17, 18 could be helical springs while, in contrast, hydraulic or pneumatic dampers, possibly of a controllable type, could be used for damping.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A screw centrifuge comprising:

a drum including a rotor, the drum having two axial ends and a horizontal axis of rotation;

a screw arranged in the drum and configured to rotate relative to the drum at a speed different from a rotation speed of the drum;

a bearing device located at each axial end of the drum and configured to bear the drum;

each bearing device including a housing and a pair of cantilevers extending in opposite directions away from the housing; and a pair of spring elements associated with each bearing device and configured for sprung support of the drum and each spring is arranged between one of the cantilevers and a frame, spring elements being located at each axial end of the drum.

2. The screw centrifuge of claim 1, wherein a ratio between a length of the drum to a diameter of the drum is greater than 2.

3. The screw centrifuge of claim 2, wherein the spring elements are configured as combined spring and damping elements.

4. The screw centrifuge of claim 3, wherein a damping of the separate damping elements is a function of a rotation speed such that a high damping level is produced even at low rotation speeds by driving through a rotor natural shape, while a lower damping level is provided at an operating rotation speed above a resonant frequency.

5. The screw centrifuge of claim 1, wherein the spring elements are configured as combined spring and damping elements.

6. The screw centrifuge of claim 1, further comprising at least one damping element separate from the pair of spring elements.

7. The screw centrifuge of claim 1, wherein the spring elements act as compression elements for the sprung support of the drum on the frame in a non-radial direction.

8. The screw centrifuge claim 1, wherein the spring elements include helical springs, and longitudinal axes of the helical springs are aligned at an angle of 0 to 30° from the vertical.

9. The screw centrifuge of claim 8, wherein the helical springs are aligned at an angle of 0 to 15° from the vertical.

10. The screw centrifuge of claim 8, wherein each helical spring is loaded in compression in the vertical direction and is loaded in shear in the axial direction.

11. The screw centrifuge of claim 1, wherein the spring elements have a tunable spring stiffness in at least two mutually perpendicular directions.

12. The screw centrifuge of claim 1, wherein the spring elements have a horizontal spring stiffness of 30% to 100% of a vertical spring stiffness when longitudinal axes of the spring elements are aligned vertically in an installed state.

13. The screw centrifuge of claim 1, wherein the spring elements have a horizontal spring stiffness of 50%-100% of a vertical spring stiffness when longitudinal axes of the spring elements are aligned vertically.

14. The screw centrifuge of claim 1, further comprising a pair of damping elements which are arranged physically separately from the spring elements and are configured to support the drum.

15. The screw centrifuge of claim 14, wherein a damping of the separate damping elements is a function of a rotation speed such that a high damping level is produced even at low rotation speeds by driving through a rotor natural shape, while a lower damping level is provided at an operating rotation speed above a resonant frequency.

16. The screw centrifuge of claim 1, wherein the spring elements are arranged alongside the drum.

17. The screw centrifuge of claim 1, wherein the two cantilevers are aligned in a common plane.

18. The screw centrifuge of claim 1, wherein the two cantilevers are aligned at an angle to a horizontal plane of the frame.

19. The screw centrifuge of claim 1, wherein the two cantilevers are arranged above the axis of rotation of the drum.

20. The screw centrifuge of claim 1, wherein the bearing devices each have two bearings and the spring elements are arranged on a plane at right angles to the axis of rotation, which axis of rotation is located between the bearings.

21. The screw centrifuge of claim 20, wherein a center of the spring elements in an axial direction alongside the bearings is located at a height which corresponds to a height of a center of the bearings.

22. The screw centrifuge of claim 20, wherein one of the two bearings is a grooved ball bearing and the other bearing is a cylindrical roller bearing, and the two bearings are arranged in a respective one of the bearing housings.

23. The screw centrifuge of claim 1, wherein a distance between the two bearings is at least half of an internal diameter of the bearings.

24. The screw centrifuge of claim 1, wherein a damping of the spring elements at resonance is at least 3%.

25. The screw centrifuge of claim 1, wherein a ratio between a length of the drum to a diameter of the drum is greater than 2.5.

26. The screw centrifuge of claim 1, wherein a ratio between a length of the drum to a diameter of the drum is greater than 3.

27. The screw centrifuge of claim 1, wherein a damping of the spring elements at resonance is at least between 10% and 30%.

* * * * *